US006102023A

United States Patent [19]

Ishiwata et al.

[11] Patent Number: 6,102,023

[45] Date of Patent: Aug. 15, 2000

[54] PRECISION CUTTING APPARATUS AND CUTTING METHOD USING THE SAME

[75] Inventors: Souichi Ishiwata; Kazuma Sekiya; Takayuki Umahashi, all of Tokyo, Japan

[73] Assignee: Disco Corporation, Tokyo, Japan

[21] Appl. No.: 09/107,447

[22] Filed: Jun. 30, 1998

[30] Foreign Application Priority Data

Jul. 2, 1997 [JP] Japan ..... 9-176935
Aug. 28, 1997 [JP] Japan ..... 9-232183

[51] Int. Cl.[7] ..... B28D 1/04

[52] U.S. Cl. ..... 125/13.01; 83/425.2; 125/14; 451/194

[58] Field of Search ..... 125/12, 13.01, 125/14, 35; 83/425.2, 471.3; 451/194, 195

[56] References Cited

U.S. PATENT DOCUMENTS 11,746 10/1854 Deering, Sr. .
882,724 6/1908 Currier .
2,187,299 1/1940 Burkhardt .
2,592,001 4/1952 Bereit .
3,289,662 12/1966 Garrison .
4,407,262 10/1983 Wirz et al. .
4,416,312 11/1983 Ostberg .
4,564,000 1/1986 Stern et al. .
4,688,540 8/1987 Ono .
4,705,016 11/1987 Sekiya .
5,482,026 1/1996 Russell ..... 125/12
5,842,461 12/1998 Azuma ..... 125/13.01

*Primary Examiner*—Timothy V. Eley
*Attorney, Agent, or Firm*—Arent Fox Kintner Plotkin & Kahn PLLC

[57] ABSTRACT

Disclosed is an improved precision cutting apparatus comprising a chuck table for holding a workpiece, and first and second cutting means each including a spindle unit having a blade attached thereto. The first and second cutting means are series-arranged with their blades opposing a predetermined distance apart, thereby cutting along two traces at one time by moving the chuck table relative to the stationary cutting means. These cutting means need not be allowed to overrun the workpiece while cutting, thus saving extra time required for overrunning which otherwise, would be required as is the case with the parallel-arrangement of two cutting means, and accordingly the dicing can be performed at an increased efficiency.

6 Claims, 12 Drawing Sheets

PRECISION CUTTING APPARATUS AND CUTTING METHOD USING THE SAME

BACKGROUND OF THE INVENTION

1. Field of the Invention

The present invention relates to a precision cutting apparatus for cutting workpieces such as semiconductor wafers or ferrite pieces, and more specifically a precision cutting apparatus using two blades for the purpose of improving the efficiency with which the cutting apparatus can cut workpieces.

2. Description of Related Art

Japanese Patent 3-11601(B) shows such a dual-blade type of precision cutting apparatus for use in dicing semiconductor wafers. It has two parallel-arranged spindle units rotatably supported in their spindle housing, each spindle unit having a cutting blade mounted to the tip end of the rotary axis. The direction in which these spindle units are arranged is referred to as "Y"-axial direction.

In making step cutting of a semiconductor wafer such a dicing apparatus can be advantageously used; one of the two cutting blades is a "V"-edged blade for cutting a "V"-shaped groove, and the other is a sharp-edged (or "I"-edged) blade for cutting the bottom of the "V"-shaped groove forming a Y-shape in cross-section, thus separating the semiconductor wafer into a plurality of chips, each having a top chamfered in all sides.

Such parallel-arrangement of two spindle units in the cutting direction or "X"-axial direction (and hence the two cutting blades arranged side by side in the "X"-axial direction) requires the spindle units to move excessively for the inter-blade center distance beyond the semiconductor wafer after crossing the full length of the workpiece because otherwise, the following blade cannot cut the workpiece to its extremity on either side of the workpiece. Apparently the overrunning on either side of the workpiece (or extra amount of cutting stroke) will lower the cutting efficiency accordingly.

SUMMARY OF THE INVENTION

In view of the above one object of the present invention is to provide a dual-blade type of precision cutting apparatus which can cut workpieces at an increased efficiency.

To attain this object a precision cutting apparatus comprising a chuck table for holding a workpiece to be cut, and first and second cutting means for cutting the workpiece held by the chuck table, is improved according to the present invention in that: the first cutting means includes a first spindle unit to which a first blade is to be fixed; the second cutting means includes a second spindle unit to which a second blade is to be fixed; and the first and second cutting means are series-arranged in linear alignment with their first and second blades opposing to each other. The series-arrangement of the first and second cutting means permits the sweeping of the cutting blades across the full width of the workpiece, not requiring the overrunning beyond either side of the workpiece as is the case with the parallel-arrangement of two cutting blades, thus leading to a substantial improvement in cutting efficiency.

The above described arrangement can be reduced to practice as follows:

- the first and second cutting means and the chuck table are adapted to move relative to each other in the X-axial direction across the Y-axial direction in which the axes of the first and second spindle units are aligned, thereby permitting the workpiece held by the chuck table to be cut in the X-axial direction;
- the first and second cutting means and the chuck table are adapted to move relative to each other in the Z-axial direction across the X-axial and Y-axial directions, thereby permitting the cutting depth to be adjusted by determining the Z-axial position of the first and second cutting means relative to the Z-axial position of the chuck table; and
- the first and second cutting means are adapted to move independently in the Y-axial direction, thereby permitting the first and second cutting means to move toward or apart from each other by moving the first cutting means and/or the second cutting means in the Y-axial direction.

Also, a precision cutting apparatus comprising a chuck table for holding a workpiece to be cut, the chuck table being adapted to travel on-cutting path formed in the X-axial direction, and first and second cutting means for cutting the workpiece is improved according to the present invention in that: the first cutting means includes a first spindle unit to which a first blade is to be fixed; the second cutting means includes a second spindle unit to which a second blade is to be fixed; and the first and second cutting means hang from an indexing-and-feeding path extending in the Y-axial direction and straddling the feeding-and-cutting path, the first and second blades of the first and second cutting means being in opposing relation, and being permitted to be incrementally fed independently in the Y-axial direction.

The cutter-suspending arrangement permits the compact designing of the cutting apparatus, facilitating the feeding-and-cutting of workpieces.

The above described arrangement can be reduced to practice as follows:

- an upright guide wall has the indexing-and-feeding path provided on one side of the guide wall, the upright guide wall having a gate-like opening, not interfering with the feeding of the chuck table for cutting operation;
- a guide rail or rails are laid on the indexing-and-feeding path for guiding the indexing-and-feeding of the first and second cutting means in the Y-axial direction;
- a linear scale is along the indexing-and-feeding path, thereby permitting the indexing-and-feeding of the first and second cutting means in the Y-axial direction to be controlled with the aid of the linear scale;
- a single linear scale is provided to be used by the first and second cutting means in common;
- the first and second cutting means are adapted to be driven by associated threaded rods;
- the first and second cutting means have threaded rods exclusively allotted thereto for independent drive; and
- the first and second cutting means have a threaded rod in common, each cutting means having a feeding nut threadedly engaged with the threaded rod.

A cutting method according to the present invention uses a precision cutting apparatus comprising a chuck table for holding the workpiece, and first and second cutting means for cutting the workpiece held by the chuck table, the first cutting means including a first spindle unit to which a first blade is to be fixed, and the second cutting means including a second spindle unit to which a second blade is to be fixed, the first and second cutting means being series-arranged in linear alignment with their first and second blades opposing to each other, the first and second cutting means and the chuck table being adapted to move relative to each other in the X-axial direction across the Y-axial direction in which the axes of the first and second spindle units are aligned, thereby permitting the workpiece held by the chuck table to be cut in the X-axial direction. The cutting method using such a precision cutting apparatus comprises the steps of: putting the first and second blades on the opposite sides of the workpiece in the Y-axial direction; moving the first and second blades toward each other step by step, thereby allowing each blade to advance an incremental distance toward the center of the workpiece; and making the first and second cutting means and the chuck table to move relative to each other in the X-axial direction, thereby cutting the workpiece.

One of the first and second cutting blades is selectively used in cutting the uncut area of workpiece which remains between the first and second blades when getting closest to each other in case that the minimum inter-distance remaining therebetween is longer than the incremental feeding distance. The first and second cutting blades are of same kind.

The cutting method according to another aspect of the present invention comprises the steps of: putting the first and second blades at the center of the workpiece; moving the first and second blades apart from each other step by step in the Y-axial direction, thereby allowing each blade to withdraw an incremental distance toward one or the other side of the workpiece; and making the first and second cutting means and the chuck table to move relative to each other in the X-axial direction, thereby cutting the workpiece.

One of the first and second cutting blades is selectively used in cutting the uncut area of workpiece which remains between the first and second blades when putting them at the center of the workpiece in case that the minimum inter-distance remaining therebetween is longer than the incremental feeding distance. The first and second cutting blades are of same kind.

The cutting method as described above requires no extra amount of cutting stroke beyond the periphery of the workpiece.

The cutting method according to still another aspect of the present invention comprises the steps of: putting the first blade on one side of the workpiece and the second blade at the center of the workpiece; moving the first blade toward the center of the workpiece and the second blade toward the other side of the workpiece in the Y-direction, thereby allowing the first and second cutting means to move an incremental distance in one and same direction; and making the first and second cutting means and the chuck table to move relative to each other in the X-axial direction, thereby cutting the workpiece. The first and second cutting blades are of same kind.

When a rectangular or square workpiece is diced, this cutting method cannot be allowed to run vainly at any times while cutting all streets of the workpiece two by two simultaneously.

The cutting method according to still another aspect of the present invention comprises the steps of: putting the first blade in a first cutting position on the workpiece; making the first cutting means and the chuck table to move relative to each other in the X-axial direction, thereby forming a groove in the workpiece; putting the second blade in the groove thus formed in the workpiece; and making the second cutting means and the chuck table to move relative to each other in the X-axial direction, thereby cutting the remaining bottom of the groove. The first and second cutting blades are of different kinds.

According to this cutting method it requires no extra amount of cutting stroke beyond the periphery of the workpiece and also enables to perform step cutting with different kinds of cutting blades in combination.

Other objects and advantages of the present invention will be understood from the following description of preferred embodiments of the present invention, which are shown in accompanying drawings.

DESCRIPTION OF THE PREFERRED EMBODIMENTS

Figure 1:
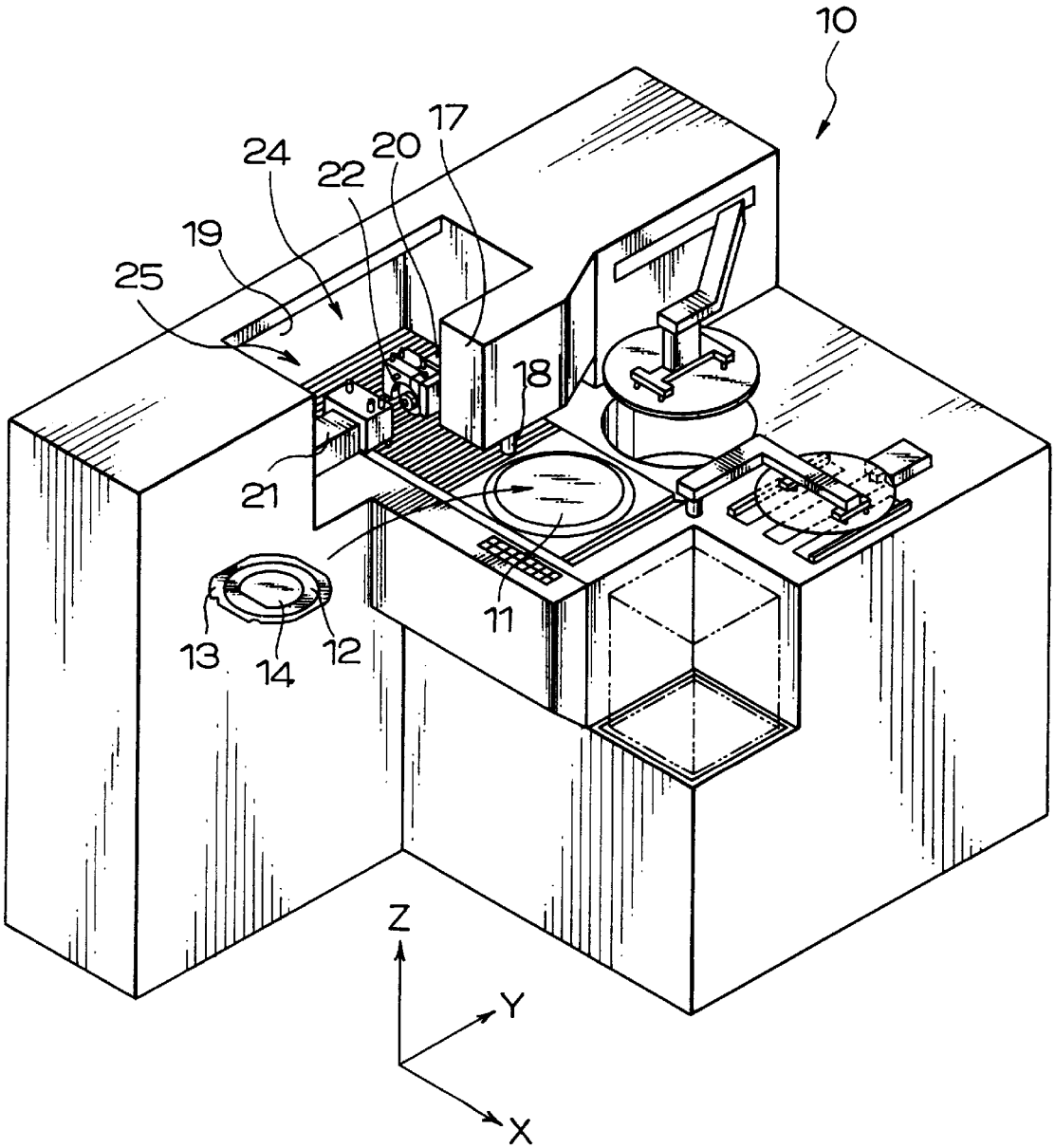
FIG. 1 is a perspective view of a dicing apparatus according to one embodiment of the present invention.

FIG. 1 shows a dicing apparatus 10 according to one embodiment of the present invention. It comprises a chuck table 11 for holding a workpiece 14 to be cut, and first and second cutting means 24 and 25 for cutting the workpiece 14 held by the chuck table 11. The first cutting means 24 includes a first spindle unit 20 to which a first blade 22 is detachably attached, and the second cutting means 25 includes a second spindle unit 21 to which a second blade 23 is detachably attached. The first and second cutting means 24 and 25 are series-arranged in linear alignment with their first and second blades 22 and 23 opposing to each other. The chuck table 11 are adapted to move relative to the first and second cutting means 24 and 25 in the X-axial direction across the Y-axial direction in which the axes of the first and second, spindle units 20 and 21 are aligned, thereby permitting the workpiece 14 held by the chuck table 11 to be cut in the X-axial direction. The first and second cutting means 24 and 25 are adapted to move relative to the chuck table 11 in the Z-axial direction across the X-axial and Y-axial directions, thereby permitting the cutting depth to be adjusted by determining the Z-axial position of the first and second cutting means 24 and 25 relative to the Z-axial position of the chuck table 11.

In operation, a semiconductor wafer 14 is held on an associated frame 13 with the aid of an adhesive tape 12 (see FIG. 2), and the framed semiconductor wafer 14 is put on the chuck table 11 to be positively held thereon by applying a negative pressure to the semiconductor wafer 14.

Figure 2:
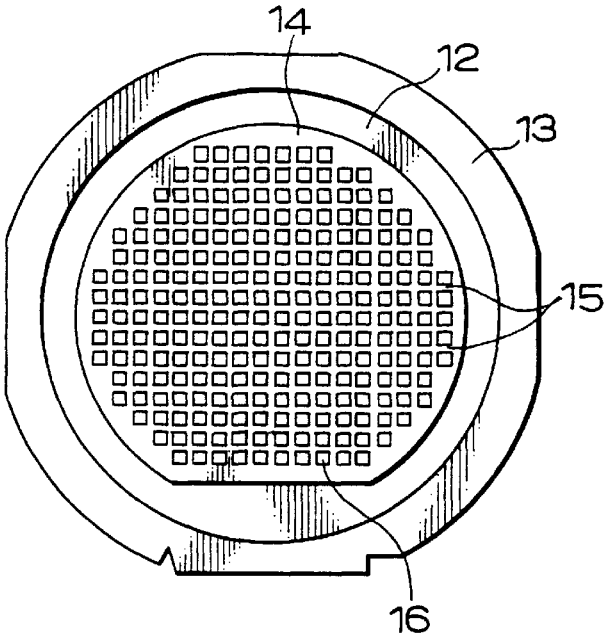
FIG. 2 is a plane view of a semiconductor wafer to be diced.

As seen from FIG. 2, the semiconductor wafer 14 has a plurality of streets 15 crosswise-arranged to form a grid pattern defining a plurality of rectangular areas 16, each having a circuit pattern formed therein. These rectangular areas 16 are separated to form chips when the semiconductor wafer 14 is diced.

The chuck table 11 is movable in the X-axial direction. It is driven in the X-axial direction until the semiconductor wafer 14 is brought to be just below alignment-establishing means 17. The chuck table 11 can be so designed that it may be driven in the Z-axial direction, when occasions demand.

The alignment-establishing means 17 has a picture-taking means such as a CCD camera 18 contained therein, and a picture of the semiconductor wafer 14 is taken to detect the crosswise streets 15 in the semiconductor wafer 14 after being subjected to the pattern matching process. Further advance of the chuck table 11 in the X-axial direction will put the semiconductor wafer 14 in the cutting section 19.

In the cutting section 19 the first spindle unit 20 and the second spindle unit 21 are aligned with their first and second blades 22 and 23 opposing to each other. The first spindle unit 20 and the first blade 22 attached thereto makes up the first cutting means 24 whereas the second spindle unit 21 and the second blade 23 attached thereto makes up the second cutting means 25. The first spindle unit 20 and the second spindle unit 21 are movable independently in the Z-axial direction.

Figure 3:
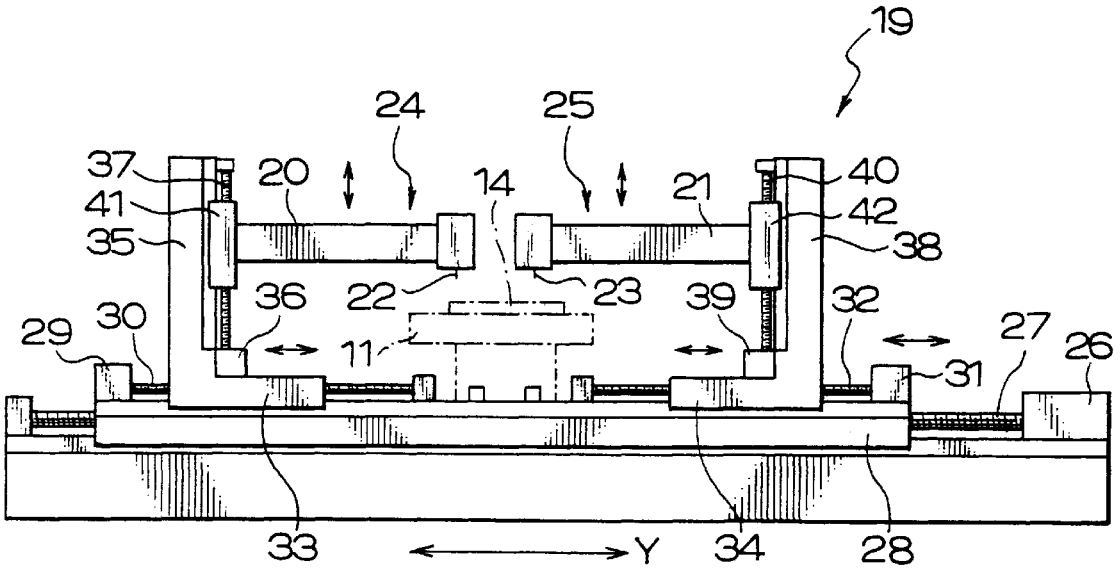
FIG. 3 shows the cutting section of the dicing apparatus.

Referring to FIG. 3, the cutting section 19 comprises a first movable base 28, a second movable base 33 and a third movable base 34. The second movable base 33 and the third movable base 34 are slidably laid on the first movable base 28. Specifically the first movable base 28 has a first threaded rod 27 threadedly engaged with its nut, and it can be driven in the Y-axial direction by a first motor 26, the shaft of which is connected to the first threaded rod 27. The second movable base 33 has a second threaded rod 30 threadedly engaged with its nut, and it can be driven in the Y-axial direction by a second motor 29, the shaft of which is connected to the second threaded rod 30. Likewise, the third movable base 34 has a third threaded rod 32 threadedly engaged with its nut, and it can be driven in the Y-axial direction by a third motor 31, the shaft of which is connected to the third threaded rod 32. Thus, the first movable base 28 bears movably the first spindle unit 20 and the second spindle unit 21.

As shown, the second base 33 has a first upright support 35 standing at one end of the second base 33, and the upright support 35 has a fourth threaded rod 37 and a fourth motor 36 for rotating the fourth threaded rod 37. Likewise, the third base 34 has a second upright support 38 standing at one end of the third base 34, and the second upright support 38 has a fifth threaded rod 40 and a fifth motor 39 for rotating the fifth threaded rod 40.

A first spindle-support 41 is threadedly engaged with the fourth threaded rod 37, and the first spindle-support 41 can be driven up and down in the Z-axial direction by rotating the fourth motor 36. Likewise, a second spindle-support 42 is threadedly engaged with the fifth threaded rod 40, and the second spindle-support 42 can be driven up and down in the Z-axial direction by rotating the fifth motor 39. As shown, the first spindle unit 20 is integrally connected to the first spindle-support 41 whereas the second spindle unit 21 is integrally connected to the second spindle-support 42.

A first disc blade 22 is attached to the tip end of the rotary spindle of the first spindle unit 20 whereas a second disc blade 23 is attached to the tip end of the rotary spindle of the second spindle unit 21. A variety of disc blades can be selectively used to meet a particular groove shape. For example, a "V"-edged blade is used to cut a "V"-shaped groove. The first and second blades may be of same or different shapes.

In dicing a semiconductor wafer 14 the second and third bases 33 and 34 are driven toward each other in the Y-axial direction so that the second and third bases 33 and 34 may be put in correct position relative to the underlying semiconductor wafer 14. The first and second blades 22 and 23 are rotated, and the fourth and fifth threaded rods 37 and 40 are rotated to lower the first and second spindle-supports 41 and 42. Then, the chuck table 11 is driven in the X-axial direction, and in the Z-axial direction when occasions demand. Thus, the semiconductor wafer 14 is cut in the X-axial direction.

Figure 4:
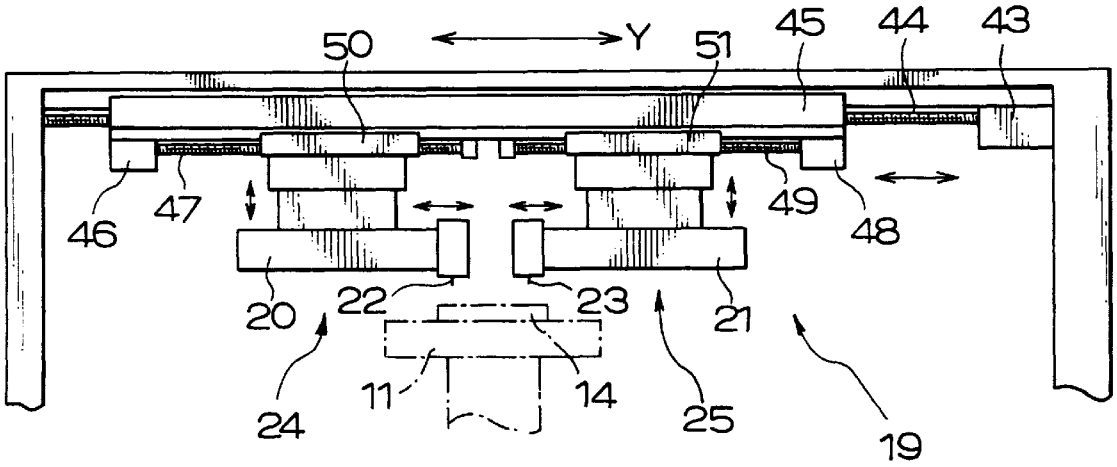
FIG. 4 shows the cutting section of a dicing apparatus according to another embodiment of the present invention.

FIG. 4 shows another example of cutting section 19 using an arch-like guide frame having: a first threaded rod 44 extending from one to the other end in the Y-axial direction to be rotated by a first motor 43 associated therewith; and a first base 45 threadedly engaged with the first threaded rod 44 to be driven in the Y-axial direction when the first threaded rod 44 is made to rotate. The first base 45 has a second threaded rod 47 to be rotated by an associated second motor 46, and a third threaded rod 48 to be rotated by an associated third motor 48. A first spindle-support 50 is threadedly engaged with the second threaded rod 47 to be driven in the Y-axial direction when the second threaded rod 47 is rotated whereas a second spindle-support 51 is threadedly engaged with the third threaded rod 49 to be driven in the Y-axial direction when the third threaded rod 49 is rotated. The first spindle-support 50 has a first spindle unit 20 hanging therefrom, and the first spindle unit 20 has a first blade 22 attached to its tip end whereas the second spindle-support 51 has a second spindle unit 21 hanging therefrom, and the second spindle unit 21 has a second blade 23 attached to its tip end. Thus, the first and second spindle units 20 and 21 can travel toward or apart from each other on the common base 45.

Figure 5:
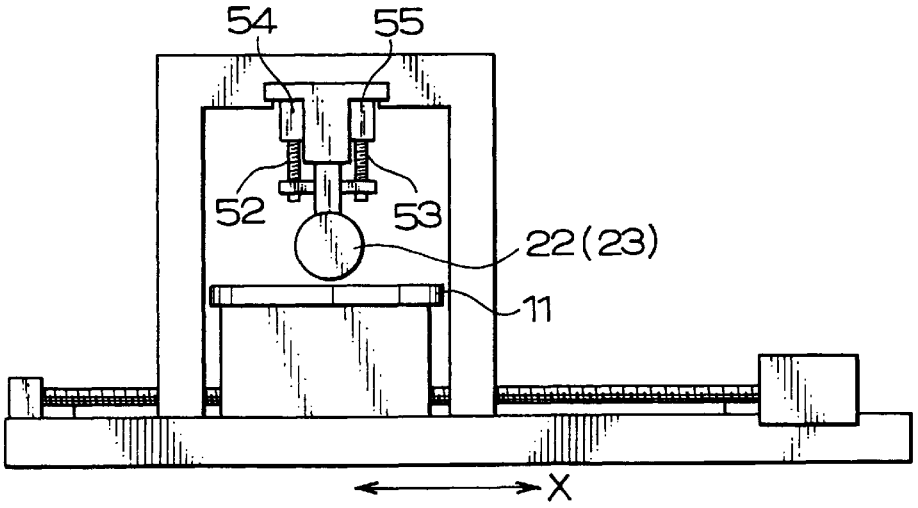
FIG. 5 shows the cutting section of the dicing apparatus as viewed in the Y-axial direction in FIG. 4.

Referring to FIG. 5, each of the first and second spindle units 20 and 21 is threadedly engaged with a fourth threaded rod 52 and a fifth threaded rod 53 to be raised or lowered by rotating a fourth motor 54 and a fifth motor 55 associated with each spindle-support.

Figure 6:
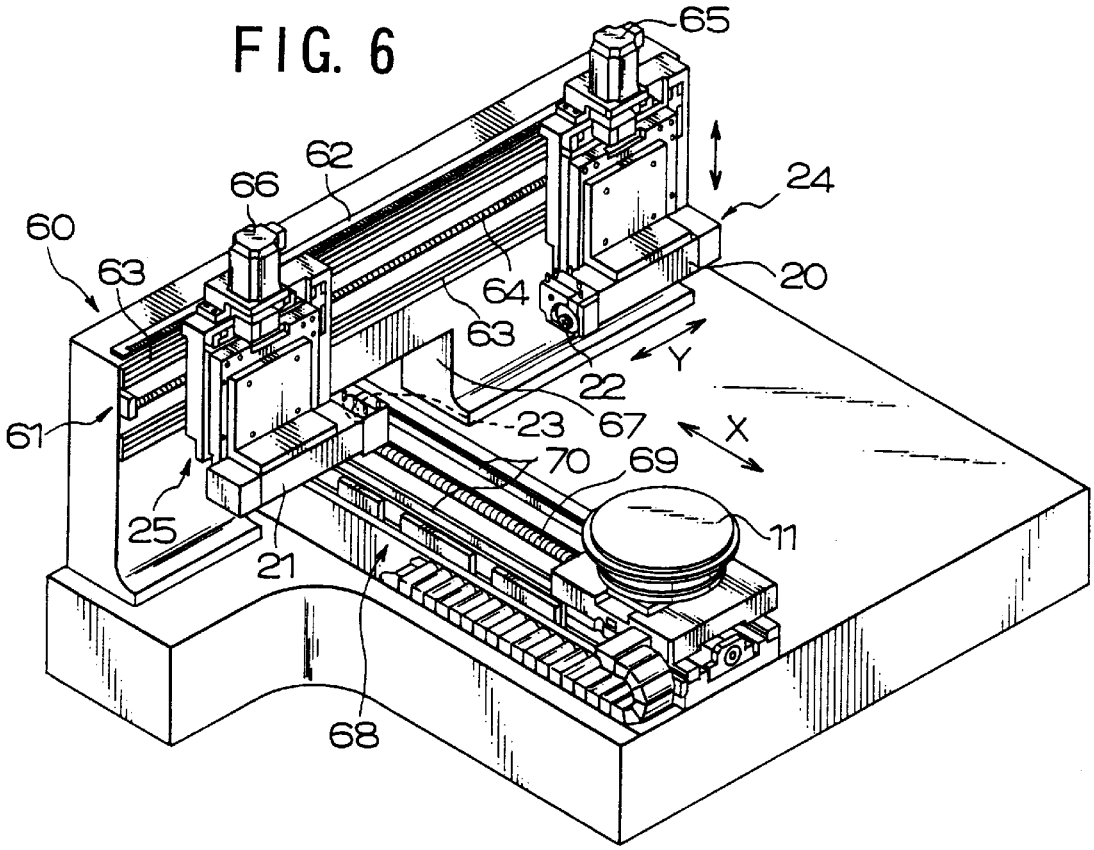
FIG. 6 is a perspective view of one example of the cutting section of the cutter-suspending type.

FIG. 6 shows such an overhead type of cutting section in detail. The arch-like guide wall 60 has an indexing-and-feeding path 61 formed on one side for feeding the first and second cutting means 24 and 25 in the Y-axial direction.

The indexing-and-feeding path 61 is composed of a linear scale 62 extending in the Y-axial direction, a pair of guide rails 63 and a stationary screw 64, and the first and second cutting means 24 and 25 ride on the guide rails 63. Each cutting means 24 or 25 has a rotary nut (not shown) threadedly engaged with the stationary screw 64, and can be driven an indexed distance in the Y-axial direction by rotating its rotary nut.

The first spindle unit 20 of the first cutting means 24 has the first blade 22 on its rotary axis whereas the second spindle unit 21 of the second cutting means 25 has the second blade 23 on its rotary axis. The first and second spindle units 20 and 21 are opposed to each other with their rotary axes aligned in the Y-axial direction.

The first cutting means 24 has a first stepping motor 65 fixed to its top for controlling the rising and descending of the first spindle unit 20 in the Z-axial direction whereas the second cutting means 25 has a second stepping motor 66 fixed to its top for controlling the rising and descending of the second spindle unit 21 in the Z-axial direction. The first and second spindle units 20 and 21 can be driven independently in the Z-axial direction, thereby permitting each spindle unit to control the cutting depth.

A feeding-and-cutting path 68 extends in the X-axial direction, crossing the arch-like guide wall 60 as indicated at 67. The feeding-and-cutting path 68 extending without being interfered with the guide wall 60, is composed of a threaded rod 69 and a pair of second guide rails 70. The threaded rod 69 can be rotated by an associated stepping motor (not shown), and the chuck table 11 rides on the second guide rails 70 to be driven in the X-axial direction by rotating the second threaded rod 69.

Figure 7:
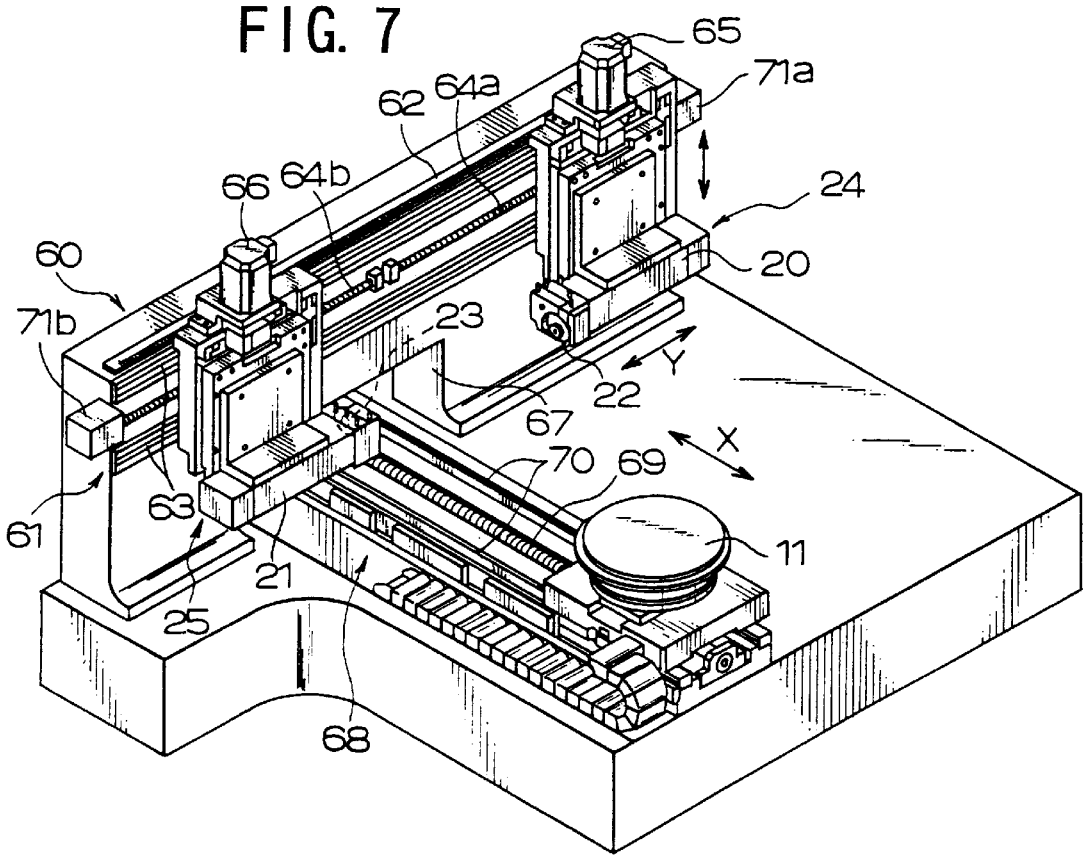
FIG. 7 is a perspective view of another example of the cutting section of the cutter-suspending type.

Referring to FIG. 7, the indexing-and-feeding path 61 may have two threaded rods 64*a* and 64*b* opposing to each other in the Y-axial direction, each threaded rod being driven separately by an associated stepping motor 71*a* or 71*b*.

Two linear scales may be used, each allotted to the first or second cutting means 24 or 25 for the purpose of independent indexing-and-feeding of each cutting means. If a minimum misalignment should appear between the opposing linear scales, the first and second cutting means 24 and 25 will be adversely affected in position. Preferably the indexing-and-feeding of the first and second cutting means, therefore, may be effected by using a single linear scale.

Figure 8A:
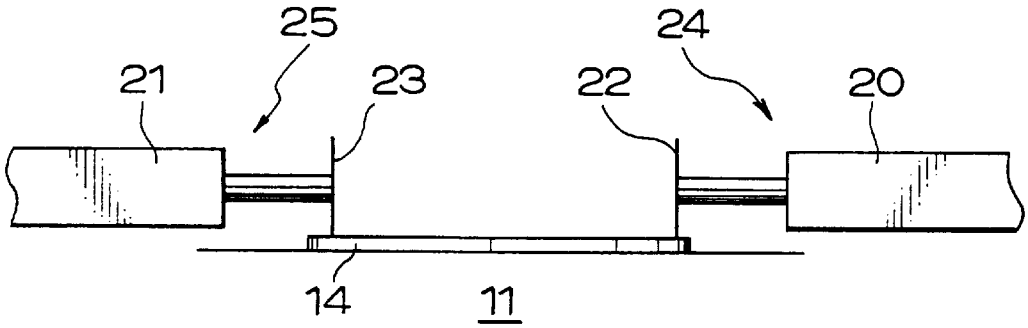
FIGS. 8(A), (B) and (C) illustrate a first example of cutting method according to the present invention.
Figure 9A:
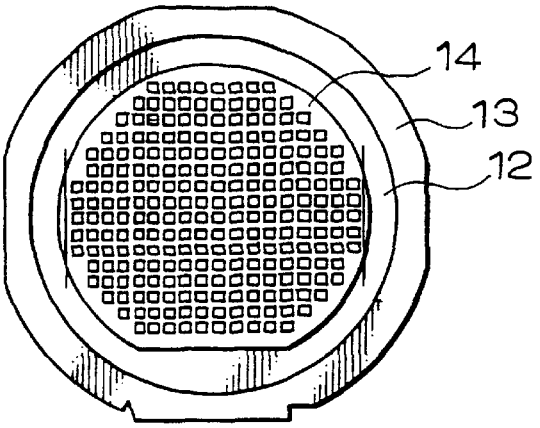
FIGS. 9(A), (B) and (C) illustrate- how a semiconductor wafer an be diced according to the cutting method of FIG. 8.

Semiconductor wafers 14 can be diced by moving the first and second spindle units 20 and 21 in different modes, as follows:

referring to FIG. 8(A), the first and second blades 22 and 23 are lowered and put on the opposite sides of the workpiece 14, exactly on the outermost streets of the semiconductor wafer 14; and the chuck table 11 is made to advance in the X-axial direction, thereby permitting the first and second blades 22 and 23 to move across the semiconductor wafer 14, cutting two grooves along the outermost streets simultaneously (see FIG. 9(A)).

Figure 9B:
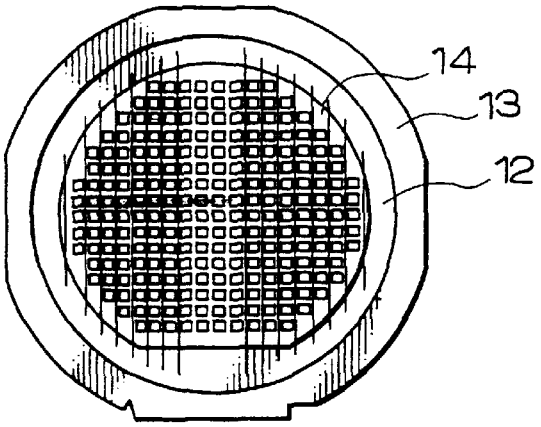

Next, the first and second cutting means 24 and 25 are moved an inter-street distance toward the center of the semiconductor wafer 14 in the Y-axial direction, and the chuck table 11 is made to advance in the X-axial direction, thereby permitting the first and second blades 22 and 23 to move across the semiconductor wafer 14, cutting two grooves along the outermost-but-one streets simultaneously (see FIG. 9(B)). This is repeated, and every time two grooves are cut simultaneously. The first and second cutting means 24 and 25 are moved same distance or stroke across the semiconductor wafer every time.

Figure 8B:
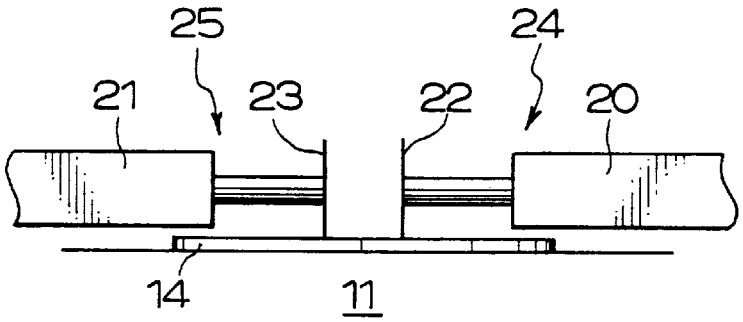
Figure 8C:
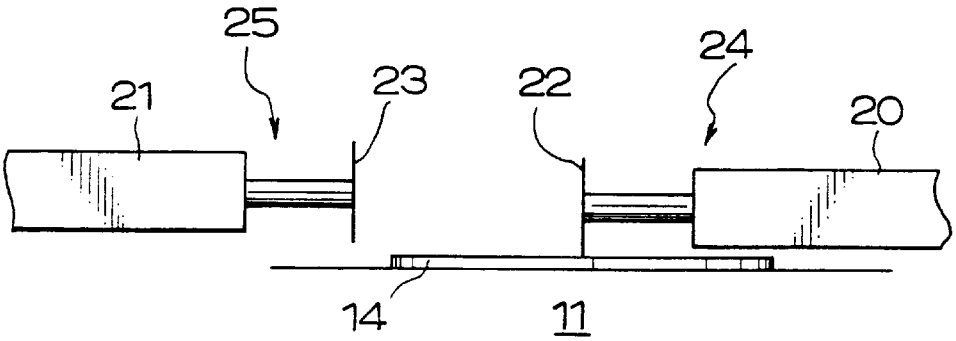
Figure 9C:
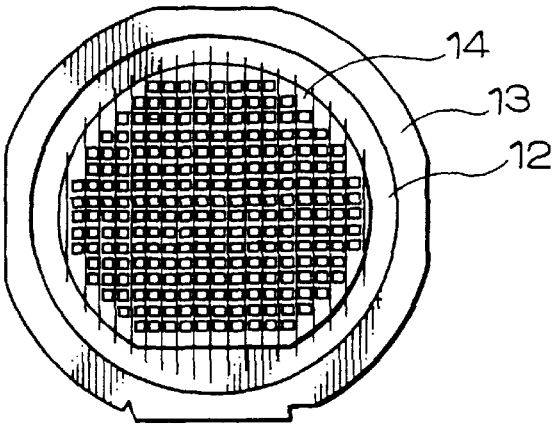

Each blade 22 or 23 has a flange protruding outward, and the blade is partly encased in a blade cover although not shown in FIG. 8. In this connection the opposing blades 22 and 23 cannot be put in contact with each other, leaving a minimum space therebetween in the vicinity of the center of the semiconductor wafer. If the minimum space is wider than the inter-street distance, there remains an ungrooved zone across the center of the semiconductor wafer 14 (see FIG. 9(B)). One of the first and second cutting blades 22 and 23 (for example, the blade 22) is selectively used in cutting the uncut zone of the semiconductor wafer 14, thereby completing the cutting of the semiconductor wafer 14 along all streets (see FIG. 9(C)).

In this cutting mode the first and second blades 22 and 23 can cut the semiconductor wafer 14 along all streets by permitting them to travel one and same distances every time.

Figure 10A:
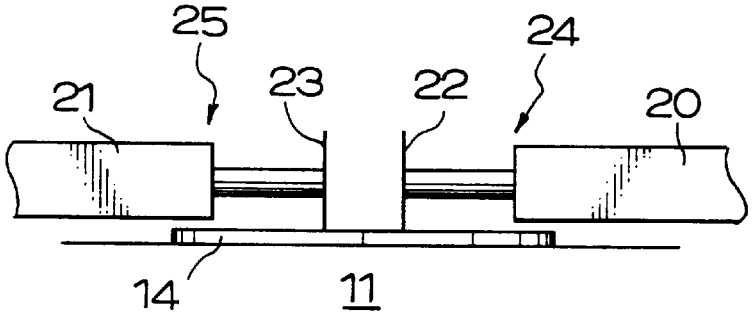
FIGS. 10(A), (B) and (C) illustrate a second example of cutting method according to the present invention.

Referring to FIG. 10(A), the first and second blades 22 and 23 are lowered and put on two selected streets in the vicinity of the center of the workpiece 14, leaving a possible minimum space therebetween, not causing any interference with each other. Then, the chuck table 11 is made to advance in the X-axial direction, thereby permitting the first and second blades 22 and 23 to move across the semiconductor wafer 14, simultaneously cutting two grooves along the selected streets (see FIG. 11(A)).

Figure 10B:
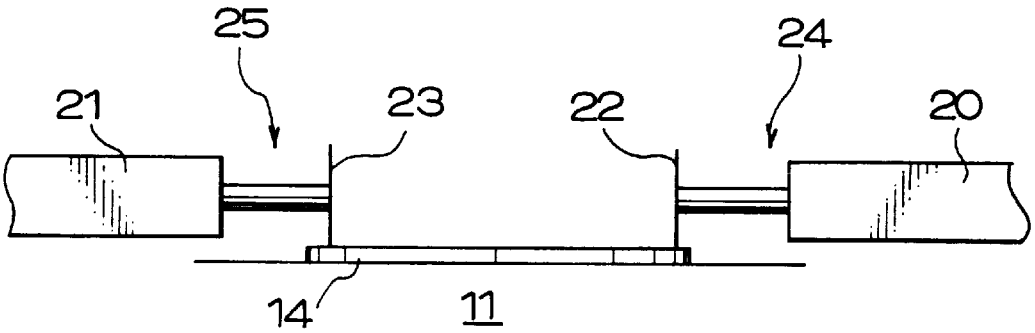

Next, the first and second cutting means 24 and 25 are moved an inter-street distance apart from the center of the semiconductor wafer 14 in the opposite Y-axial directions, and the chuck table 11 is made to advance in the X-axial direction, thereby permitting the first and second blades 22 and 23 to move across the semiconductor wafer 14, simultaneously cutting two grooves along the selected streets adjacent to the first selected streets. This is repeated until the first and second blades 22 and 23 have reached the outermost streets (see FIG. 10(B) and FIG. 11(B)). Every time two grooves can be made simultaneously by permitting the first and second cutting means 24 and 25 to move same distance or stroke across the semiconductor wafer 14.

Figure 11A:
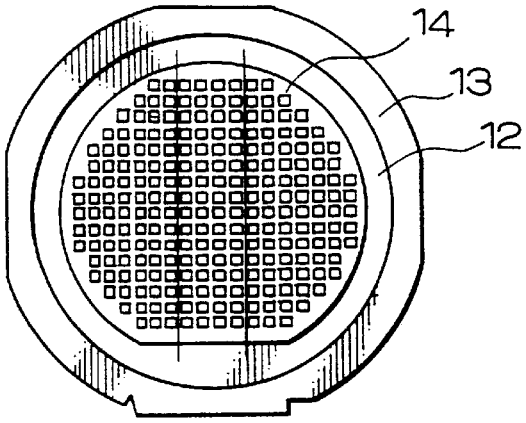
FIGS. 11(A), (B) and (C) illustrate how a semiconductor wafer can be diced according to the cutting method of FIG. 10.
Figure 11B:
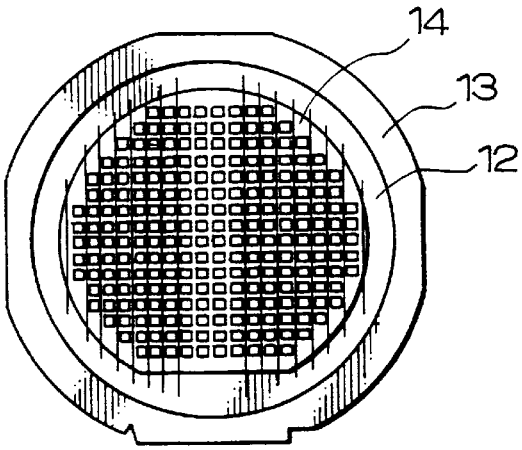
Figure 11C:
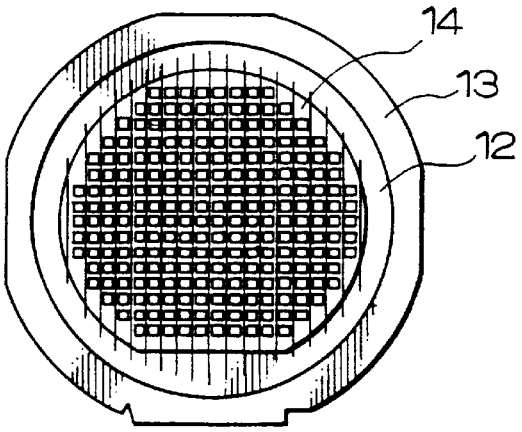

If the minimum space is wider than the inter-street distance, there remains an ungrooved center zone across the semiconductor wafer 14 (see FIG. 11(A)). One of the first and second cutting blades 22 and 23 (for example, the blade 22) is selectively used in cutting the uncut zone of the semiconductor wafer 14, thus completing the cutting of the semiconductor wafer 14 along all streets (see FIG. 11(C)).

In this cutting mode the first and second blades 22 and 23 can cut the semiconductor wafer 14 along all streets by permitting them to travel one and same distances every time, as is the case with FIG. 8.

Figure 12A:
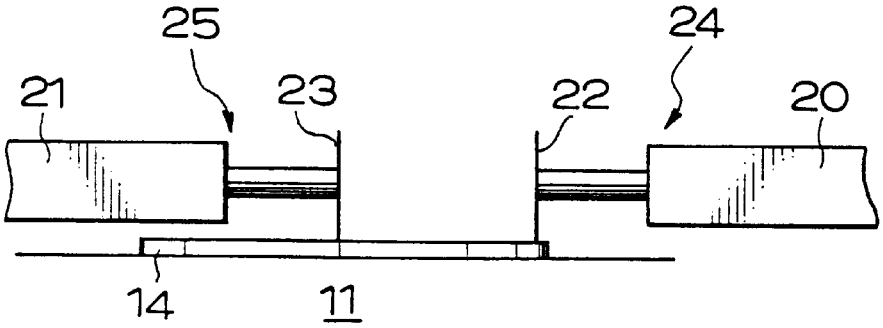
FIGS. 12(A), (B) and(C) illustrate a third example of cutting method according to the present invention.
Figure 13A:
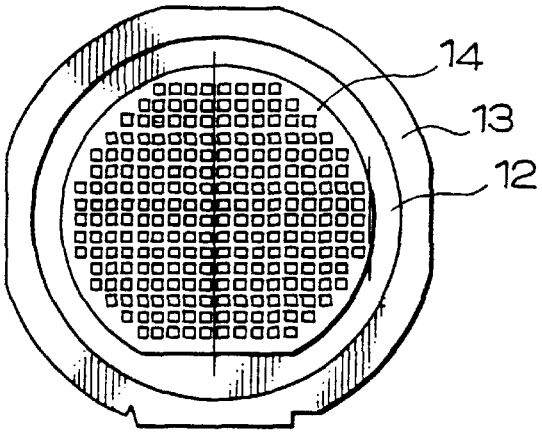
FIGS. 13(A), (B) and (C) illustrate how a semiconductor wafer can be diced according to the cutting method of FIG. 12.

Referring to FIG. 12(A), the first and second blades 22 and 23 are lowered and put on the workpiece 14 with the first blade 22 at one end of the semiconductor wafer 14 and with the second blade 23 at the center of the semiconductor wafer 14. Then, the chuck table 11 is made to advance in the X-axial direction, thereby permitting the first and second blades 22 and 23 to move across the semiconductor wafer 14, simultaneously cutting two grooves along the center and outermost streets (see FIG. 13(A)).

Figure 12B:
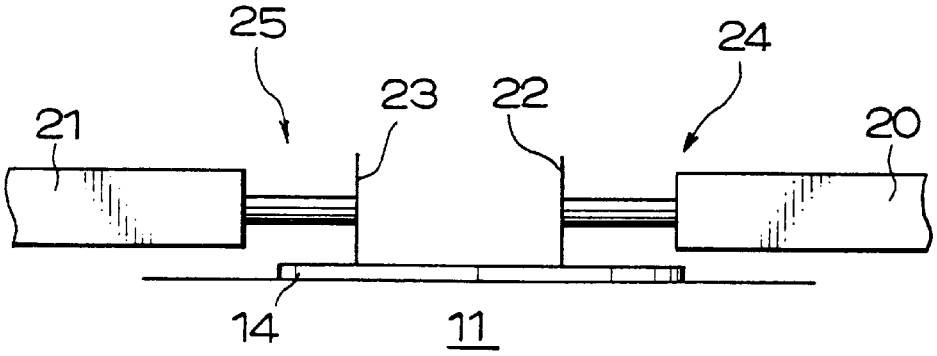
Figure 12C:
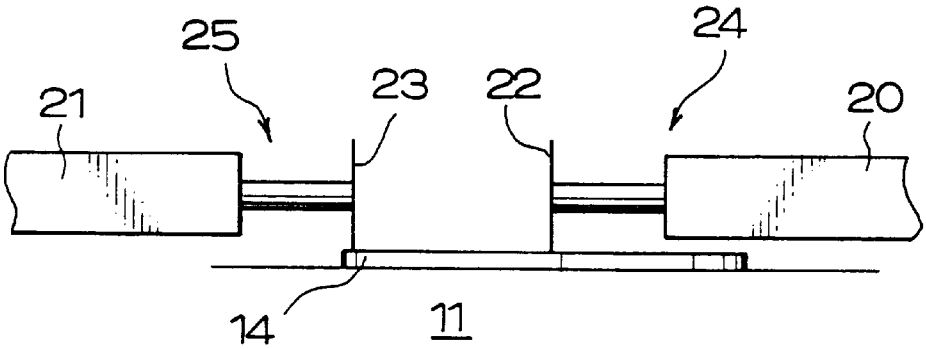
Figure 13B:
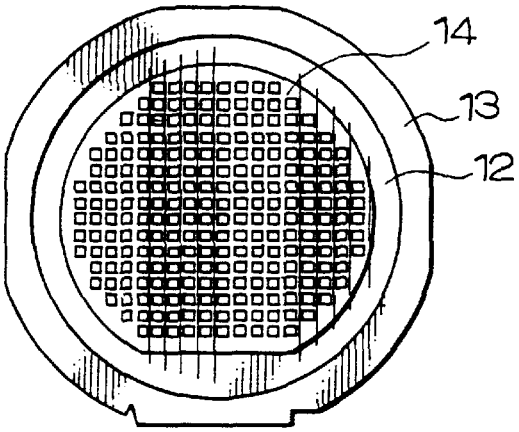
Figure 13C:
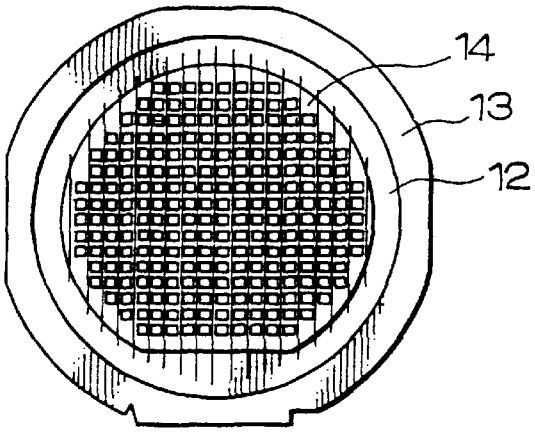

Next, the first and second cutting means 24 and 25 are moved an inter-street distance toward the other end of the semiconductor wafer 14, keeping the first and second cutting means 24 and 25 at same interval (see FIG. 12(B) and FIG. 12(C)). Then, the chuck table 11 is made to advance in the X-axial direction, thereby permitting the first and second blades 22 and 23 to move across the semiconductor wafer 14, simultaneously cutting two grooves along the selected streets adjacent to the center and outermost streets (see FIG. 13(B)). This is repeated until the second blade 23 has reached the outermost street at the other end of the semiconductor wafer 14 (see FIG. 12(C) and FIG. 13(C)). Every time two grooves can be made simultaneously by permitting the first and second cutting means 24 and 25 to move same distance or stroke across the semiconductor wafer 14.

Figure 10C:
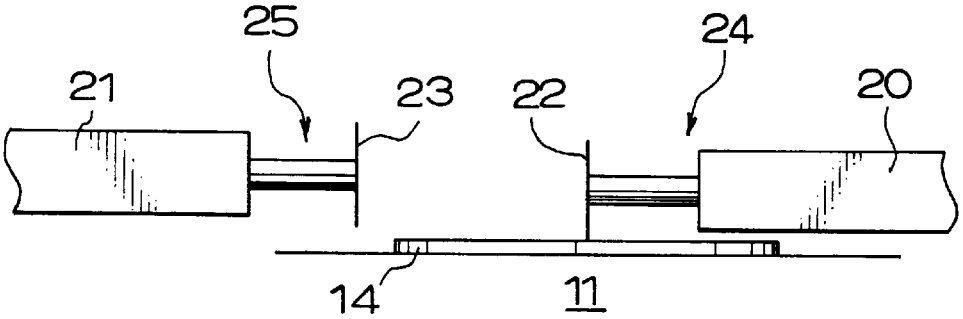

In this cutting mode all streets can be grooved or cut two by two simultaneously although either cutting means 24 or 25 is allowed to overrun the semiconductor wafer 14, different from the cutting modes as illustrated in FIGS. 8 and 10. If a rectangular or square workpiece is diced, the first and second cutting means 24 and 25 cannot be allowed to run vainly at any times while cutting all streets of the workpiece two by two simultaneously.

Referring to FIG. 14, in a Y-cutting mode a groove is made with a V-edged blade so that the groove has a V-shape in cross-section, not deep enough to reach the back of the workpiece, and then, the V-shaped groove is cut on its bottom with a sharp-edged blade to reach the back of the workpiece, thus cutting the workpiece in chamfered pieces.

Figure 14A:
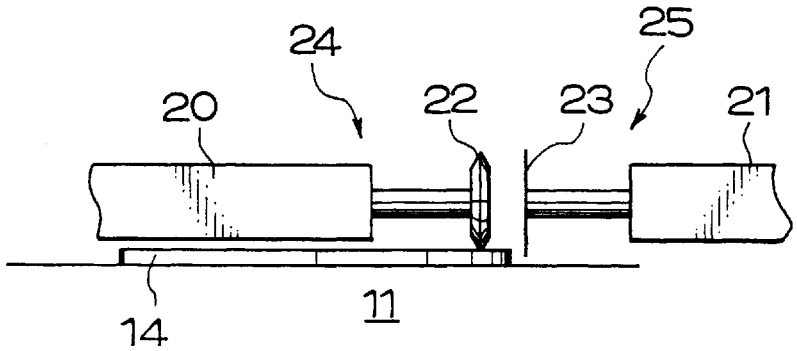
FIGS. 14(A), (B) and (C) illustrate a fourth example of cutting method according to the present invention.
Figure 14B:
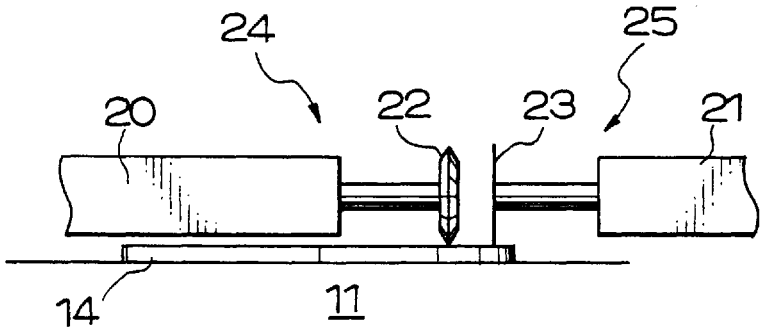
Figure 14C:
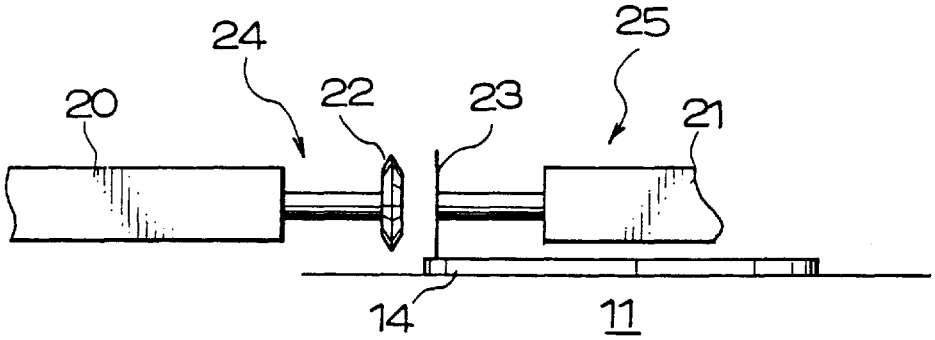
Figure 15A:
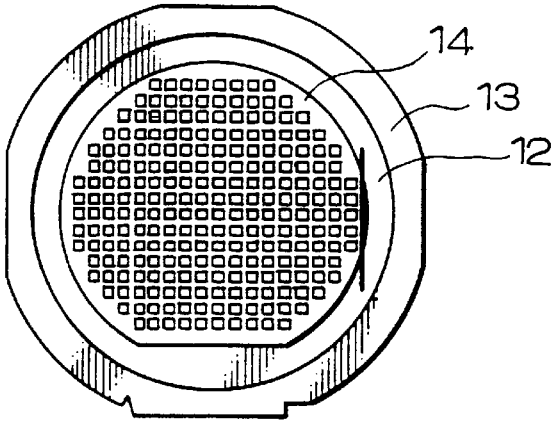
FIGS. 15(A), (B) and (C) illustrate how a semiconductor wafer can be diced according to the cutting method of FIG. 14.

Referring to FIG. 14(A), a V-edged blade is used as the first blade 22, and a sharp-edged blade is used as the second blade 23, and these blades are kept apart by an inter-street distance. The first blade 22 is put on a selected street, and the chuck table 11 is made to advance in the X-axial direction, thereby permitting the first blade 22 to move across the semiconductor wafer 14, cutting a V-shaped groove at the first cutting step (see FIG. 14(A) and FIG. 15(A), thick line).

Figure 15B:
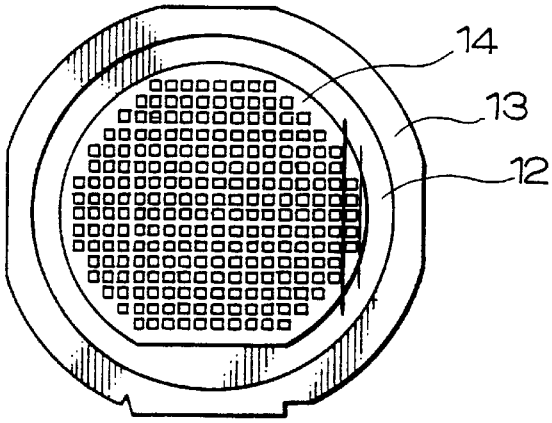
Figure 15C:
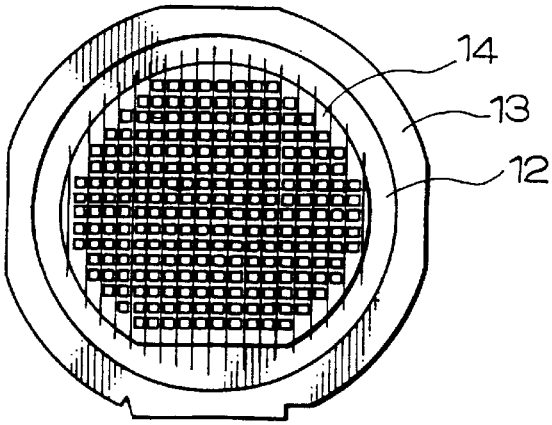

Next, the first cutting means 24 is moved an inter-street distance in the Y-axial direction, thus allowing the second blade 23 to be put in the V-shaped groove 23. Then, the chuck table 11 is made to advance in the X-axial direction, thereby permitting the first blade 22 to cut another V-shaped groove, and at the same time permitting the second blade 23 to cut and separate the semiconductor wafer along the first V-shaped groove at the second cutting step (see FIG. 14(B) and FIG. 15(B)). This is repeated until the second blade 23 cuts the semiconductor wafer along the V-shaped groove on the outermost street (see FIG. 14(C) and FIG. 15(C)). Finally the semiconductor wafer is cut into chips each chamfered in all sides.

It should be noted that required dicings can be performed with different kinds of cutting blades in combination.

As is apparent from the above, the first and second cutting means are series-arranged with their blades opposing an inter-street distance apart, and therefore, these cutting means need not be allowed to overrun the workpiece while cutting two grooves at one time, thus saving extra time required for overrunning which otherwise, would be required as is the case with the parallel-arrangement of two cutting means.

What is claimed is:

1. A precision cutting apparatus comprising:

a chuck table to hold a workpiece that is to be cut in a fixed position, the chuck table being adapted to travel on a feeding-and-cutting path formed in an X-axial direction, first cutting means for cutting the workpiece; and second cutting means for cutting the workpiece, wherein the first cutting means is coaxial to the second cutting means and includes a first spindle unit to which a first blade is fixed, the second cutting means includes a second spindle unit to which a second blade is fixed, and the first and second cutting means hang from an indexing-and-feeding path extending in a Y-axial direction and straddle the feeding-and-cutting path, the first and second blades of the first and second cutting means being in opposing relation to each other, and capable of being permitted to be incrementally fed independently in the Y-axial direction, wherein a linear scale is provided along the indexing-and-feeding path, thereby permitting the indexing-and-feeding of the first and second cutting means in the Y-axial direction to be controlled with the aid of the linear scale and a single linear scale is provided to be used by the first and second cutting means in common.

2. A precision cutting apparatus according to claim 1 further comprising an upright guide wall wherein the indexing-and-feeding path is provided on one side of the guide wall, the upright guide wall having a gate opening, not interfering with the feeding of the chuck table for cutting operation.

3. A precision cutting apparatus according to claim 2 wherein a guide rail or rails are laid on the indexing-and-feeding path for guiding the indexing-and-feeding of the first and second cutting means in the Y-axial direction.

4. A precision cutting apparatus according to claim 1 wherein the first and second cutting means are adapted to be driven by associated threaded rods.

5. A precision cutting apparatus according to claim 4 wherein the first and second cutting means each have a threaded rod to drive the respective first and second cutting means.

6. A precision cutting apparatus according to claim 4 wherein the first and second cutting means have a threaded rod in common, each cutting means having a feeding nut threadedly engaged with the threaded rod.

* * * * *